United States Patent [19]

Mannstrom

[11] 4,059,237

[45] Nov. 22, 1977

[54] SYSTEM FOR FEEDING A DOUBLE DISC REFINER

[75] Inventor: Bo Knut Mannstrom, Kauniainen, Finland

[73] Assignee: Oy Keskuslaboratorio - Centrallaboratorium, Ab, Helsinki, Finland

[21] Appl. No.: 713,427

[22] Filed: Aug. 11, 1976

Related U.S. Application Data

[63] Continuation of Ser. No. 548,579, Feb. 10, 1975, abandoned.

[30] Foreign Application Priority Data

Feb. 15, 1974 Finland ..... 74452

[51] Int. Cl.[2] ..... B02C 23/02

[52] U.S. Cl. ..... 241/246; 162/261; 241/245; 241/247

[58] Field of Search ..... 162/261, 24, 23, 25, 162/234, 235, 236; 241/186 A, 186.1, 31, 245, 246, 247

[56] References Cited

U.S. PATENT DOCUMENTS

| | | | |
|---|---|---|---|
| 1,711,464 | 4/1929 | Ruprecht et al. | 241/186.1 |
| 2,422,522 | 6/1947 | Beveridge et al. | 162/24 X |
| 2,561,043 | 7/1951 | Ayers | 241/31 |
| 3,773,610 | 11/1973 | Shouvlin et al. | 162/261 X |
| 3,853,276 | 12/1974 | Fisher | 241/247 |
| 3,921,918 | 11/1975 | Peterson | 162/23 X |

FOREIGN PATENT DOCUMENTS

| | | | |
|---|---|---|---|
| 597,668 | 1/1948 | United Kingdom | 162/234 |

*Primary Examiner*—S. Leon Bashore
*Assistant Examiner*—Marc L. Caroff
*Attorney, Agent, or Firm*—Woodling, Krost, Granger & Rust

[57] ABSTRACT

A double disc refiner for wood products solves the problems caused by steam generation in the refining space between the feed end disc and another disc. This problem is solved by the use of a separate steam removal channel connected to an inlet passage closely adjacent the feed end disc and at a location between the feed end disc and a means for feeding wood materials into the inlet passage at one end thereof. The means for feeding wood materials feeds the materials through the inlet passage and thereafter into the refining space through openings in the feed end disc.

14 Claims, 7 Drawing Figures

SYSTEM FOR FEEDING A DOUBLE DISC REFINER

This is a continuation, of application Ser. No. 548579, filed Feb. 10, 1975, now abandoned.

This invention relates to a system of feeding wood chips, saw dust or other corresponding raw materials or pulp into a double disc refiner and to the equipment needed by this system.

The object of this invention is to improve the feeding process of a double disc refiner by replacing the equipment generally utilized by an equipment of a new type, which makes it possible to use high amounts of specific energy when refining wood materials or pulp. This would make it possible to defiberize or refine wood chips into high quality mechanical pulp in one single pass through the refiner.

The conventional method for feeding a double disc refiner is illustrated in FIG. 1. The wood chips are brought to the feeder with the aid of the horizontal screw transporter 1 A. The wood chips or the pulp is fed to the double screw feeder 2 A through a hole in the bottom plate of the screw transporter 1 A. The double screw feeder is comprised of a tube, which contains two screw spirals 3 A, 4 A. With the aid of these screws, the wood chips or the pulp are fed into the refining zone 6 A through an opening in one of the two rotating refiner discs. The rotating speed of the feeding screws can be regulated by the control motor 7 A. A characteristic feature for this double screw feeder is, that the rotational speed of the screws is low and that the wood chips or the pulp are fed as a plug into the refining zone 6 A. This type of system for feeding a double disc refiner could be regarded as a forced feeding system. This feeding system has, however, also some disadvantages.

When the refiner is run in such a way that the amount of energy per ton of pulp produced is high, 1000 - 2500 kWh/t, steam is formed in the refining zone 6 A. This steam tends to disappear either through the refining zone via the chamber 8 A, which surrounds the refiner discs 5 A and 5 B or in the backward direction via the double screw feeder 2 A of the feeding system. In order to increase the energy input per ton of chips or pulp produced, the refiner discs are moved closer to each other either by hydraulical or mechanical means. This leads to a decrease in the distance between the refiner discs at 9 A, and the wood chips or pulp passing through the refining zone 6 A are subjected to a more severe treatment. This leads to an increased steam formation but due to the decreased clearance between the refiner plates the steam discharge through the refining zone and the chamber 8 A is getting increasingly difficult. As the load of the refiner is further increased and the material is fed as a plug into the refiner, a steam pressure is build up before the refining zone. As this steam pressure increases, it will finally completely prevent the wood chips or the pulp from entering into the refining zone. In practice, this is indicated by a heavy vibration of the whole refiner or by steam discharge through the double screw feeder. The steam discharge may sometimes be so vigorous that the plug of wood chips or pulp present in the feeder is discharged by the steam. This makes it impossible to use high amounts of energy per ton of material produced when refining wood chips or pulp. For instance, it is thus not possible to refine wood chips into high quality paper pulp in one single pass through the refiner. This is true independently of a possible physical or chemical pretreatment of the wood chips. Neither does the feeding and refining of the chips under a slight pressure of 1 - 3 kp/cm$^2$ change this situation.

The object of this invention is to remove these disadvantages.

The main characteristic feature of the equipment used in the invented feeding system is that a part of the equipment is a dividing chamber, which divides the chip or pulp stream into two equal partial streams. The dividing chamber is comprised of a conical tank the bottom of which is formed by two screw feeders acting in different directions. The equipment is further comprised of two vertical channels, through which the chip or pulp streams are passed forward to two mainly horizontal screw feeders, which are so directed, that the chip or pulp streams are brought towards the openings of the feeding side disc of the refiner. The streams reach the disc symmetrically with respect to the main shaft of the refiner and they may form an angle of 0°-90°, but normally 30°-50° with the front side of refiner disc. A further characteristic feature of the equipment is a vertical steam discharge channel, which is placed above the discharge ends of the two above mentioned screw feeders and in direct contact with the feeding openings of the feeding side disc of the refiner. Inside the steam discharge channel there are one or several downwards acting screw spirals.

The invention will be more fully understood when the following detailed description and the accompanying drawings are considered, wherein.

Figure 3A:
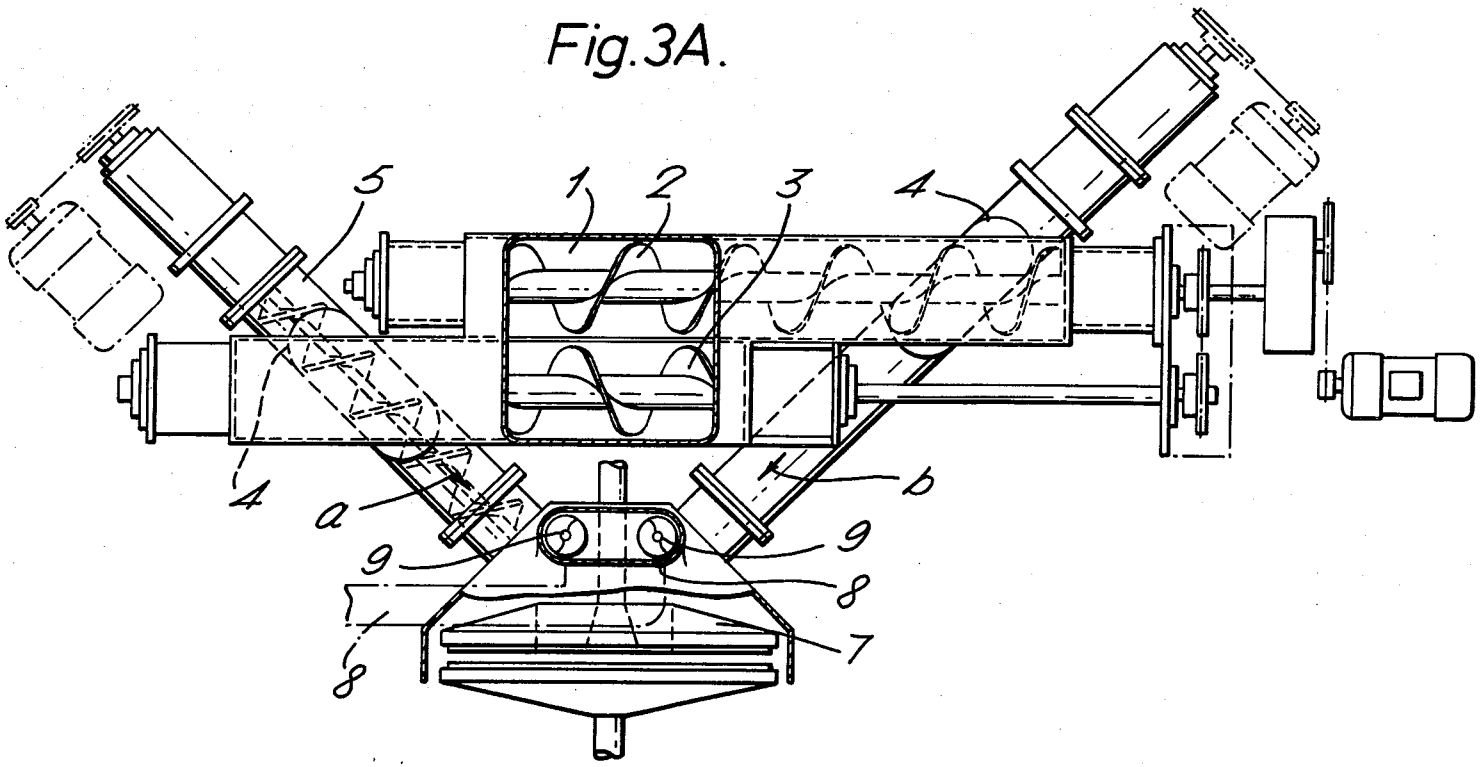
Figure 3B:
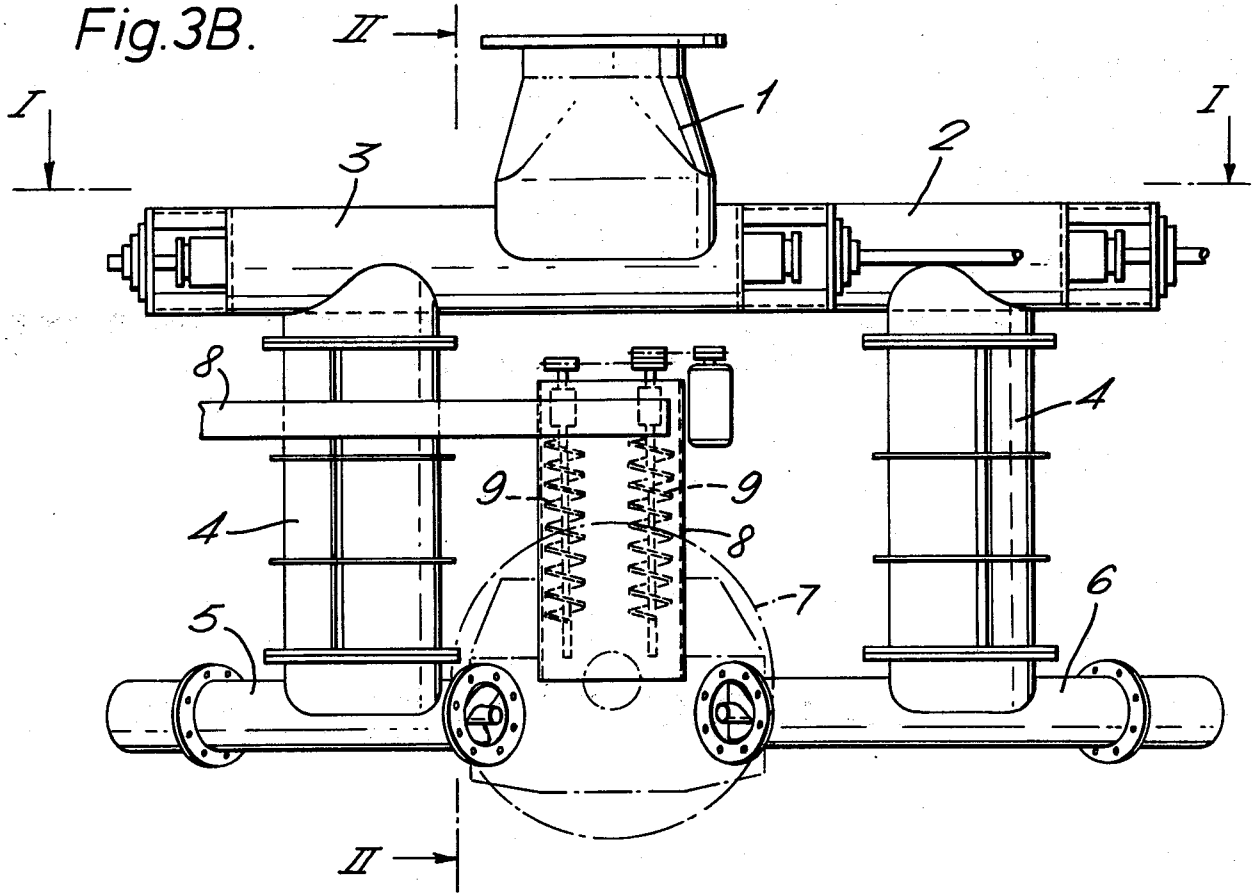
Figure 3C:
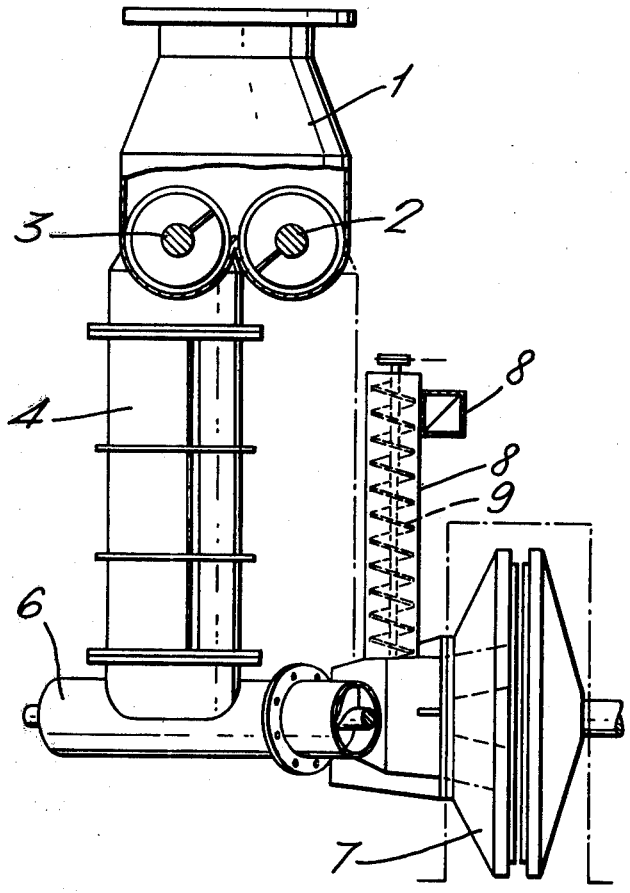

FIG. 3 A is a view from above of the equipment, with the aid of which the stream of chips or pulp brought to the refiner is divided into two equal streams and with the aid of which the partial streams are fed into the refining zone through the openings in the refiner disc.

FIG. 3 B gives a view of the same equipment taken from the end of the refiner disc. FIG. 3 C gives a longitudinal view of the same equipment.

FIG. 3 A is a sectional view along the dotted line I — I in FIG. 3 B in the direction of the arrows. FIG. 3 C is a sectional view along the dotted line II — II in FIG. 3 B in the direction of the arrows.

Figure 4:
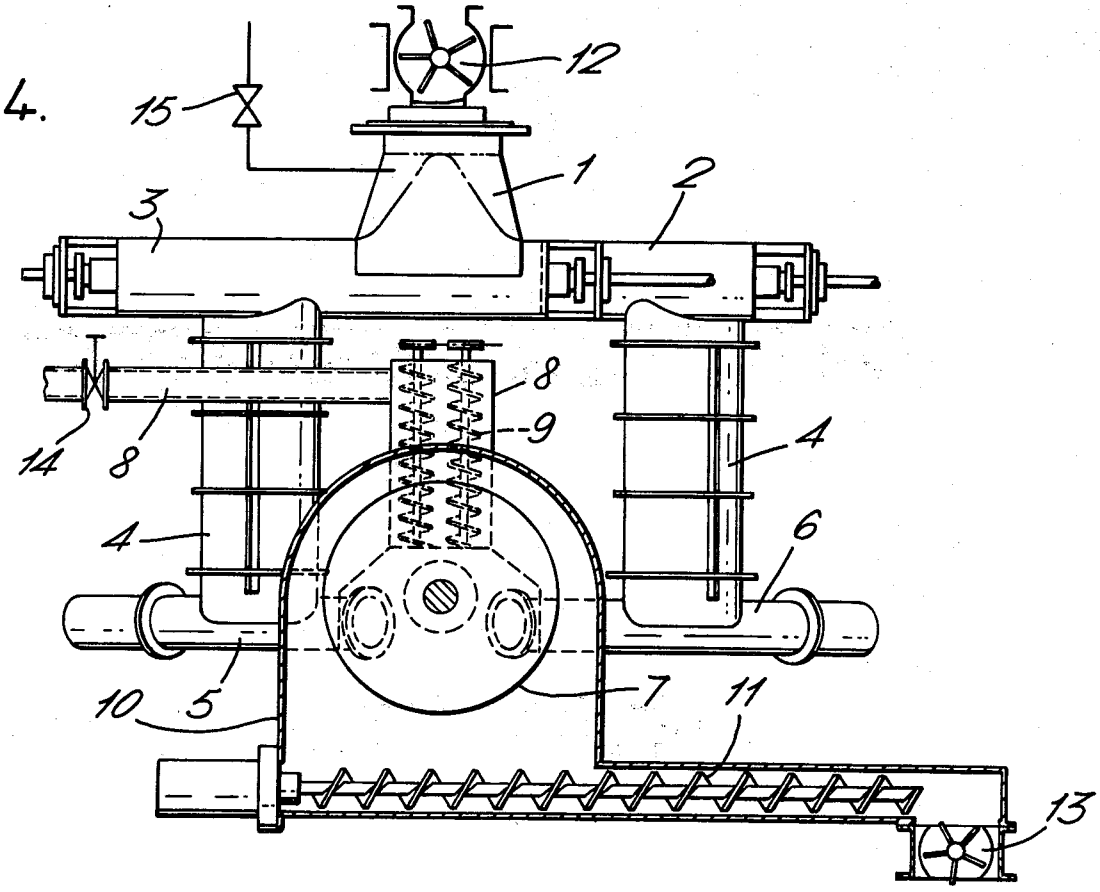
Figure 5:
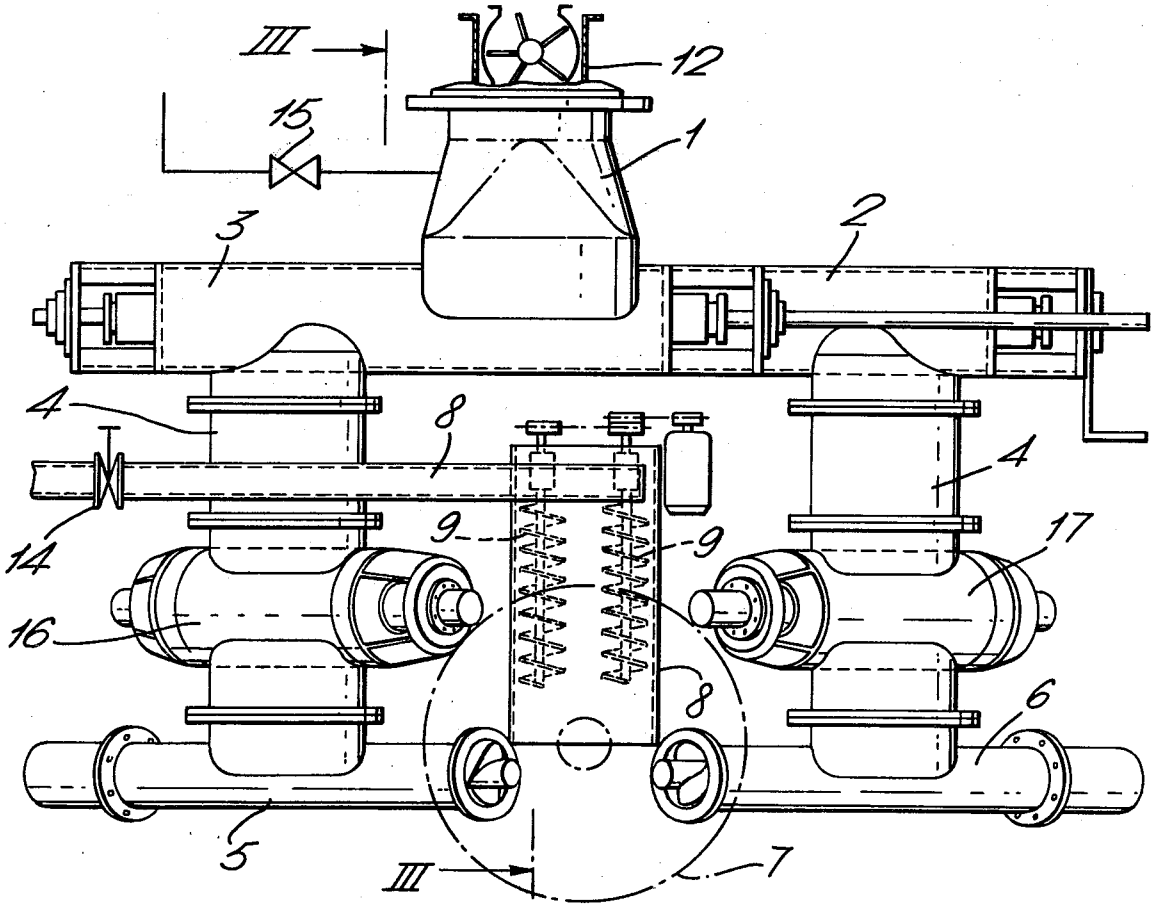

FIG. 4 is a front view of the refiner when it is used for the refining of pulp under pressure, and FIG. 5 is a front view of the refiner when it is used for the refining of wood chips or pulp, which has been pretreated under pressure in the dividing chamber.

Figure 1:
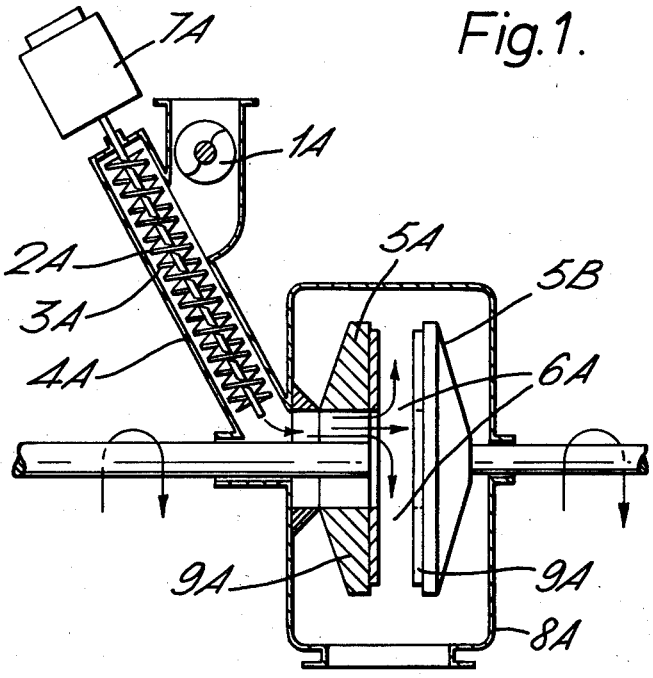
FIG. 1 is a chematic sectional view taken on the longitudinal axis of the conventional system used for feeding double disc refiners.
Figure 2:
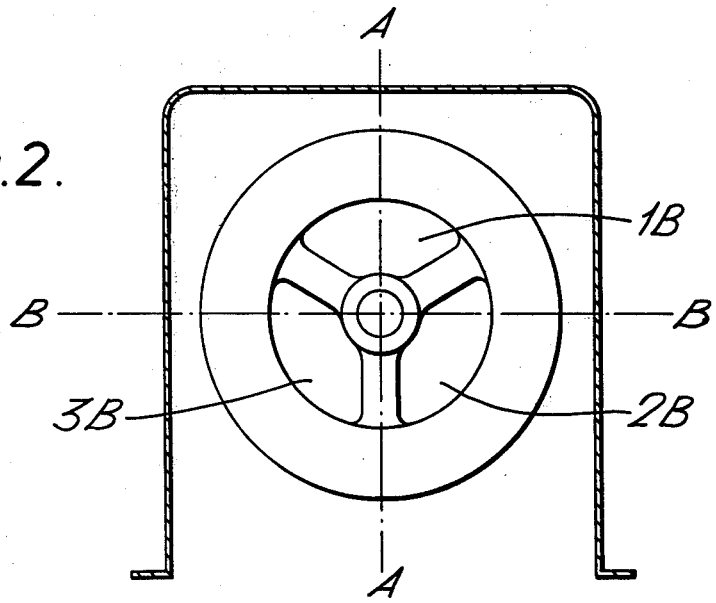
FIG. 2 is a front view of the double disc refiner feeding side disc of the type utilized in this invention.

The new feeding system is based upon the utilization of all the three openings 1 B, 2 B and 3 B of the refiner disc showed in FIG. 2, which gives a frontal view of the feeding side disc of the double disc refiner. If we now assume, that this rotating disc is in the position illustrated in FIG. 2 the openings 2 B and 3 B on both sides of the central line A — A and below the horizontal line B — B are those utilized for the feeding of wood chips or pulp into the refiner. The opening 1 B on the line A — A and above the line B — B is, at the same time, used for the removal of steam from the refining zone. In principle this means, that the equipment used for the feeding of the refiner must be able to divide the stream of chips or pulp into two equal partial streams, which are transported towards the openings 2 B and 3 B of the refiner disc. Additionally, the equipment must enable the steam to leave the refining zone through the opening 1 B without any significant amount of chips or pulp following the steam flow.

The chips or pulp is transported to the dividing box 1, which is somewhat conical in the vertical direction in order to prevent the chips or pulp from building up. The bottom of the box is formed by two similar feeding screws 2, 3, which rotate with equal speed but in opposite directions. They can also be arranged to rotate in the same direction but designed to operate in different directions. In both cases, the chips or pulp entering the box leave the box in two partial, equal streams. The rotational speed of the feeding screws can be regulated in order to make is possible to change the total amount of chips or pulp fed into the refiner per time unit. Below the end of the feeding screws 2, 3 there are discharge openings, through which the chips or pulp is fed through the vertical channels 4 on to two other mainly horizontal feeding screws 5, 6, which reach the feeding openings in the refiner disc 7 symmetrically from two sides with respect to the main shaft of the refiner and forming an angle of 0°-90°, but normally 30°-50° with the front side of the refiner disc 7. In the vertical direction the joints are situated closely either to the upper or the lower side of the main shaft of the refiner. The transporting capacity of the feeding screws 5, 6 is so dimensioned, that even only one of them is able to transport the total stream of chips or pulp to the refiner. Normally, the rotation speed of the feeding screws 5, 6 is constant and within the range of 10–1000 rpm.

The steam discharge channel, through which the steam can be removed from the refining zone, is also shown in FIG. 3 A, 3 B and 3 C. Between the discharge ends of the feeding screws 5, 6 and above the main shaft of the feeding side refiner disc there is an approximately vertical steam removal channel 8. The removed steam can be let into the surrounding air, but is preferabely fed to the chips or pulp silo, which normally is located prior to the refiner unit. In the steam removal channel 8, and particularly in that part of it, which is approximately vertical and located immediately before the feeding side refiner disc, there are one or several, in this particular case two, spiral screws 9, which rotate in such a way, that they will transport chips or pulp, possibly carried by the steam, back downwards towards the openings of the feeding side refiner disc.

The feeding system and equipments described above can be used also in cases when the wood chips or pulp is refined under pressure. FIG. 4 gives a front view of the refiner equipped with the feeding equipments described in FIG. 3 B. In FIG. 4 the case 10, always surrounding the refiner discs 7 has also been drawn, as well as the feeding screw 11 needed for the removal of the refined pulp from the refiner. If one rotary valve 12 is mounted immediately before the dividing box 1 and another rotary valve 13 at the end of the feeding screw 11 the refiner can be fed and the chips or pulp can be refined under pressure, by feeding steam into the dividing box through the valve 15. At the end of the steam removal channel 8 there is a valve 14, which is used either alone or together with the valve 15 for regulation of the steam pressure.

The steam discharge through the steam removal channel 8 can be used for preheating the wood chips or the pulp which is to be refined. Another possibility is to use this steam instead of fresh steam for maintaining the pressure by feeding it into the dividing box 1 through the valve 15. The steam produced during refining is thus utilized for the preheating and the complete system will stay pressurized. In addition, different chemicals such as caustic, soda, sulphite, bisulphite, ammonium and peroxide based pretreating chemicals can be fed into the dividing box 1, through which a pretreatment of the chips or the pulp thus can be achieved. For this purpose, the dividing box is so dimensioned that the average chips or pulp flow retention time in the box is 0–5 minutes. The steam can be utilized also in other ways; as for instance, for heating the water needed in the refining process.

The feeding equipment can also be used in such a way, that the chips or the pulp, which is to be refined, is pretreated in the pressurized dividing box, where after the refining is carried out in a nonpressurized refiner.

This alternative is illustrated in FIG. 5, which gives a front view of the refiner with the feeding equipment.

With the aid of the rotary valve 12 which is mounted to the dividing box 1, the chips or the pulp is transported to the dividing box. The screws 2, 3 of the dividing box transfer the chips or the pulp to the vertical channels 4, in which the rotary valves 16, 17 are located. These as well as the rotary valve referred to above, are well known constructions. In this way, the part of the system between the closing feeder 12 and the rotary valves 16 and 17 form a space, which can be pressurized and which can be utilized for the pretreatment of the chips or the pulp. After the rotary valves 16 and 17 the pretreated chips or pulp are transferred to the refiner with the aid of the feeding screws 5 and 6. The removal of the steam from the refiner is carried out in the way described in FIG. 3 or 4. In addition the steam, and particularly in addition to the steam formed during refining, also other chemicals, such as caustic, soda, sulphite, bisulphite, ammonium, oxygen, boron or peroxide based chemicals can be used for the pretreatment.

The invention is not restricted to the examples of applications described above. Its field of application can vary considerably within the limits described by the patent claims.

I claim:

1. In a double disc refiner which comprises a housing with an exit opening and in the housing a rotatable feed end disc spaced from a rotatable second disc to form a refining space between said discs and with the feed end disc having a plurality of openings therethrough to accommodate passage of wood materials into the refining space and a drive shaft for rotating said feed end disc, a material inlet passage within the housing and connected to the plurality of openings in the feed end disc and material feed channel means for feeding the wood materials through the inlet passage from an end of said inlet passage opposite the feed end disc and into the plurality of openings in the rotatable feed end disc and into the refining space wherein the improvement comprises a separate steam removal channel in direct connection with the rotatable feed end disc and the plurality of openings in said feed end disc by way of said inlet passage, said steam removal channel being connected to said inlet passage and located a spaced distance from said material feed channel means for feeding the wood materials.

2. In a double disc refiner as claimed in claim 1, wherein said inlet passage receives the wood materials from the material feed channel means for feeding the wood materials substantially below the drive shaft and said inlet passage receives steam from the refining space substantially above the drive shaft and said steam removal channel is connected to said inlet passage above the drive shaft.

3. In a double disc refiner as claimed in claim 1, the provision of means in said steam removal channel for forcing material carried by steam out of the refining space back into the refining space.

4. In a double disc refiner as claimed in claim 1 wherein the material feed channel means for feeding wood material to said material inlet passage is provided with screw conveyors.

5. In a double disc refiner as claimed in claim 3, wherein the means in said steam removal channel comprises a screw conveyor.

6. In a double disc refiner as claimed in claim 4, wherein means are provided to maintain the refiner under pressure from the material feed channel means for feeding the wood materials to the exit opening of the housing.

7. In a double disc refiner which comprises a housing with an exit opening and in the housing a rotatable feed end disc spaced from a rotatable second disc to form a refining space between said discs and with the feed end disc having a plurality of openings therethrough to accommodate the passage of wood materials into the refining space and a drive shaft for rotating said feed end disc, the improvement comprising an inlet passage in said housing within which extends the drive shaft, said inlet passage having first and second end portions with said first end portion terminating adjacent the plurality of openings in the feed end disc, at least two spaced apart material feed channels connected to said second end portion of said inlet passage and positioned symmetrically with respect to said drive shaft to supply wood materials to said passage, a steam removal channel connected to said inlet passage above the drive shaft and spaced from each of the material feed channels to provide for the removal of steam from the refining space.

8. In a double disc refiner as claimed in claim 7, wherein said material feed channels are located below said drive shaft and said steam removal channel is located above said drive shaft.

9. In a double disc refiner as claimed in claim 7, the provision of means in said steam removal channel for forcing material carried by steam out of the refining space back into the refining space.

10. In a double disc refiner as claimed in claim 8, the provision of screw conveyors in each of said material feed channels to move wood material to said inlet passage.

11. In a double disc refiner as claimed in claim 9, wherein the means in said steam removal channel comprises a screw conveyor.

12. In a double disc refiner as claimed in claim 10, wherein there is provided a dividing box which has an open bottom which empties into first and second screw feeders which respectively transport wood material to said separate material feed channels.

13. In a double disc refining as claimed in claim 12, wherein means are provided to maintain the refiner under pressure from the dividing box to the exit opening of the housing.

14. In a double disc refiner as claimed in claim 12, wherein means are provided to maintain under pressure the dividing box through the first and second screw feeders.

* * * * *